US007650096B2

(12) United States Patent
Azumi et al.

(10) Patent No.: US 7,650,096 B2
(45) Date of Patent: Jan. 19, 2010

(54) ELECTRIFICATION DEVICE, AND IMAGE FORMING APPARATUS

(75) Inventors: Shinichi Azumi, Nara (JP); Syouichi Fujita, Kashiba (JP); Seiichi Kizu, Ikoma (JP); Minoru Tomiyori, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 401 days.

(21) Appl. No.: 11/714,172

(22) Filed: Mar. 6, 2007

(65) Prior Publication Data

US 2007/0212105 A1 Sep. 13, 2007

(30) Foreign Application Priority Data

Mar. 10, 2006 (JP) ..... 2006-066285
Jun. 5, 2006 (JP) ..... 2006-156024

(51) Int. Cl.
*G03G 15/02* (2006.01)

(52) U.S. Cl. ..... 399/100

(58) Field of Classification Search ..... 399/100, 399/170, 171, 172, 173
See application file for complete search history.

(56) References Cited

U.S. PATENT DOCUMENTS 5,012,093 A 4/1991 Shimizu
6,931,225 B2 8/2005 Yamashita
6,963,705 B2 11/2005 Quinones
2005/0074256 A1* 4/2005 Yamashita ..... 399/100
2005/0265745 A1 12/2005 Takesawa et al.
2008/0044198 A1 2/2008 Tomiyori et al.
2008/0085134 A1 4/2008 Takiguchi et al.

FOREIGN PATENT DOCUMENTS

JP 07-319260 12/1995
JP 09-166906 6/1997
JP 09-211940 8/1997
JP 11-249393 9/1999
JP 11-288149 10/1999
JP 11-338265 12/1999

OTHER PUBLICATIONS

Office Action dated Mar. 10, 2009 in copending U.S. Appl. No. 11/819,219.
Office Action dated Aug. 17, 2009 issued in copending U.S. Appl. No. 11/819,219.
Office Action dated May 13, 2009 issued in copending U.S. Appl. No. 11/822,602.

* cited by examiner

*Primary Examiner*—Hoang Ngo
(74) *Attorney, Agent, or Firm*—Nixon & Vanderhye, PC

(57) ABSTRACT

A needle electrode and a cleaning member are provided. A plurality of needles are arrayed upon the needle electrode in a straight line, and protrude towards a surface of a photoreceptor. The cleaning member is disposed movably along the array direction of the plurality of needles between the surface of the photoreceptor and the needle electrode. When the cleaning member moves, the tip portion of each of the plurality of needles in the arranged order, after having been embedded from the surface of the cleaning member into its interior, then exits to the exterior of the cleaning member.

7 Claims, 6 Drawing Sheets

ELECTRIFICATION DEVICE, AND IMAGE FORMING APPARATUS

CROSS REFERENCE

This Nonprovisional application claims priority under 35 U.S.C. § 119(a) on Patent Application No. 2006-066285 and No. 2006-156024 filed in Japan on Mar. 10, 2006, and Jun. 5, 2006 respectively, the entire contents of which are hereby incorporated by reference.

BACKGROUND OF THE TECHNOLOGY

The present technology relates to an charging device that electrifies to a uniform electrical potential a surface of a photoreceptor that is used in an image forming apparatus that performs image formation by an electrophotographic printing method, and to an image forming apparatus that incorporates this electrification device.

In image formation processing by an electrophotographic printing method, sequentially, an electrification process, an exposure process, a development process, and a transfer process are performed to a surface of a photoreceptor.

In the electrification process, the surface of the photoreceptor is electrified to a uniform electrical potential using an electrification device.

One type of electrification device is a non contact type electrification device that does not contact the surface of the photoreceptor. Such a non contact type electrification device electrifies the surface of the photoreceptor by electric discharge from an electrode to which a high voltage electricity is supplied.

In an electrification device that uses a charger line of diameter from some tens of μm to 150 μm, ozone is generated from the charger line during electric discharge due to application of high voltage electrical power, and this contaminates the environment.

Because of this problem, there is an alternative type of electrification device that uses a needle electrode, with which the amount of ozone generated when a high voltage power supply is applied is small. In such a needle electrode, a plurality of needles are arranged along a direction that is orthogonal to a shifting direction of the surface of the photoreceptor, protruding towards the surface of the photoreceptor. During use, dirt and dust in the vicinity of the portion where a high voltage electric field is generated are adsorbed upon the needles of the needle electrode. If this matter is neglected, it becomes impossible to perform adequate electrical discharge from the needle electrode.

Thus, as for example described in Japanese Laid-Open Patent Publication H11-338265, with such a prior art electrification device, a pair of pad members are provided so as to face one another with the needles of the needle electrode sandwiched between them, and so as to be movable along the direction in which the plurality of needles are arranged. By shifting these pad members along the direction in which the plurality of needles are arranged, the pad members are caused to come into contact with the surfaces of the plurality of needles sequentially, so that dirt and dust adhered to the needles is eliminated.

However, the pad members that are provided to such a prior art type electrification device have been made from materials such as felt or the like. Due to this, it is not possible to apply a sufficient elastic force to these pad members, and the ends of the needles of the needle electrode can easily be deformed. Moreover, the fibers of the felt may be cut by contact with the needles, and loose portions thereof can adhere to the surfaces of the needles, thus contaminating the needle electrode. Furthermore, since the pad members contact the sides of the needles that are parallel to the direction in which they are arranged, accordingly it is not possible reliably to clean the entire tip portions of the needles, which are the portions thereof to which dust can most easily adhere due to application of the high voltage electrical field.

The object of the present technology is to provide an electrification device with which, by shifting an elastic member in which the ends of a plurality of needles of a needle electrode are embedded, along the direction in which the needles are arrayed and past the tips of the needles, the entire tip portions of the needles can be cleaned reliably, without deformation of the needles or adherence of fibers taking place; and to provide an image forming apparatus that incorporates such an electrification device.

SUMMARY OF THE TECHNOLOGY

In the present technology, a needle electrode and a cleaning member are provided. A plurality of needles are arrayed upon the needle electrode in a straight line, and protrude towards a surface of a photoreceptor. The cleaning member is disposed movable along the array direction of the plurality of needles between the surface of the photoreceptor and the needle electrode. When the cleaning member moves, the tip portion of each of the plurality of needles in the arrayed order, after having been embedded from the surface of the cleaning member into its interior, then exit to the exterior of the cleaning member.

DETAILED DESCRIPTION OF THE TECHNOLOGY

Figure 1:
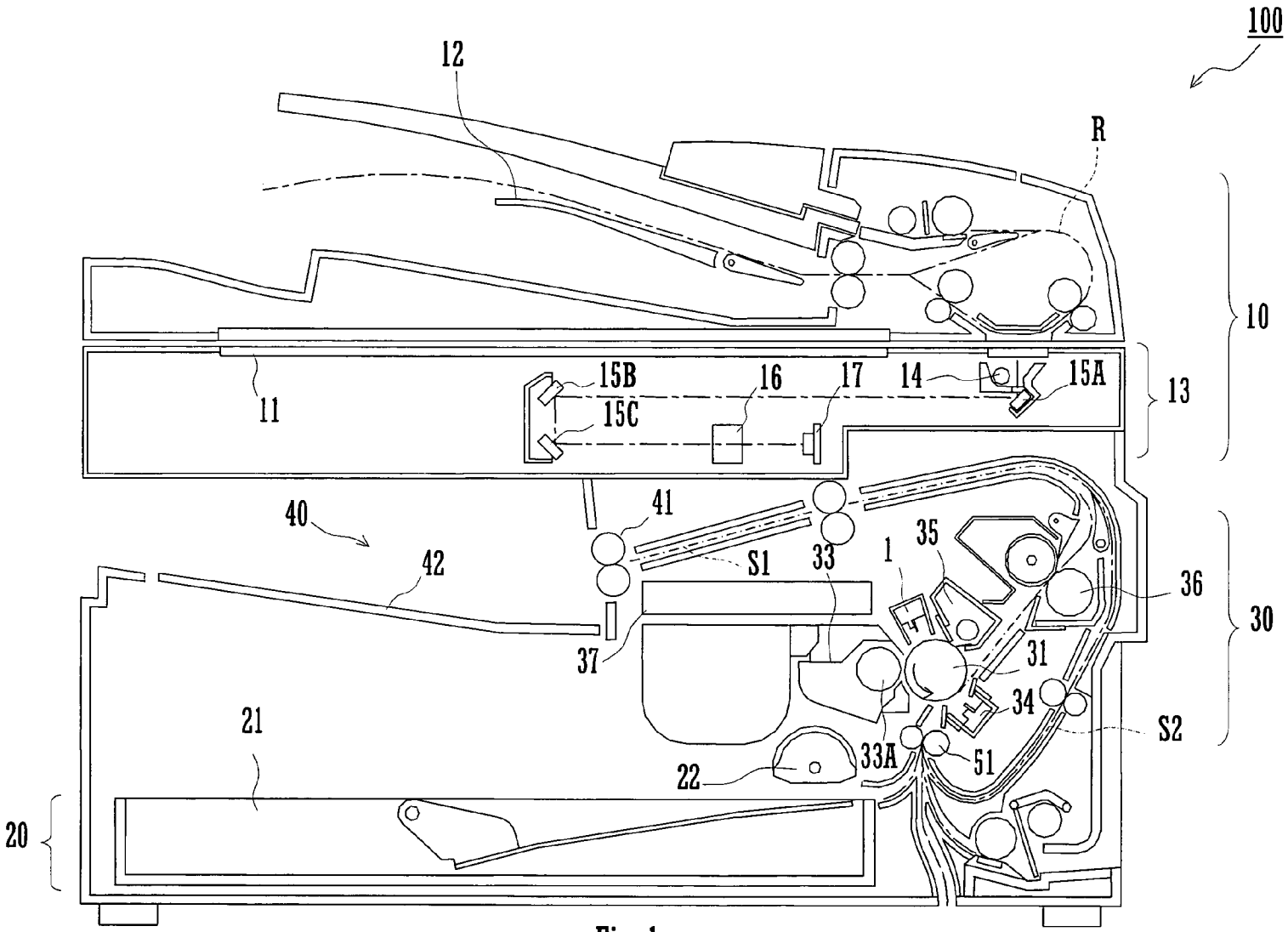
FIG. 1 is a sectional view of an image forming apparatus to which a charging device is applied.

In the following, preferred embodiments will be described in detail with reference to the drawings. FIG. 1 is a sectional view of an image forming apparatus 100 to which a charging device 1 is applied. As image formation modes in which it forms images upon paper (including recording media such as OHP transparency film and the like), this image forming apparatus 100 has a copier mode, a printer mode, and a FAX mode. These modes are selected by an operator. With this image forming apparatus 100, it is possible to perform double sided printing in which images are formed upon both sides of the paper.

The image forming apparatus 100 includes an original reading unit 10, a paper supply unit 20, an image formation unit 30, a paper delivery unit 40, and an operation panel section and so on not shown in the figures. The original reading unit 10 is disposed upon the upper portion of a main body of the image forming apparatus 100, and includes a platen glass 11, an original tray 12, a scanner 13, and the like. The scanner 13 includes a light source 14, reflecting mirrors 15A through 15C, an optical lens 16, and a CCD (Charge Coupled Device) 17. The light source 14 irradiates light upon an original that is mounted upon the platen 11, or upon an original that is being conveyed from the original tray 12 upon an original conveyance path R. The reflection mirrors 15A through 15C conduct the light reflected from the manuscript to the optical lens 16. The optical lens 16 images the reflected light conducted by the reflection mirrors 15A through 15C upon the CCD 17. And the CCD 17 outputs an electrical signal corresponding to this reflected light.

The paper supply unit 20 is disposed at the lower portion of the main body, and includes a paper supply tray 21 and a pickup roller 22. The paper supply tray 21 stores paper for supply to the image formation unit 30 during image formation. And, as it rotates, the pickup roller 22 supplies a sheet of paper stored in the paper supply tray 21 one by one.

The image formation unit 30 is disposed below the original reading unit 10, and includes paper stop rollers 51, a laser scanning unit (hereinafter termed the LSU) 37, a photoreceptor drum 31, and a fixing device 36. An charging device 1, a development device 33, a transfer device 34, and a cleaner unit 35 are disposed around the photoreceptor drum 31 in order along the direction of the arrow in FIG. 1, that is the direction of rotation of the photoreceptor drum 31. The paper stop rollers 51 conduct a sheet of paper that has been supplied from the paper supply unit 20 in between the photoreceptor drum 31 and the transfer device 34. Paper conveyance paths S1 and S2 are defined in this image formation unit 30.

The paper delivery unit 40 is arranged over the paper supply tray 21, and includes paper discharge rollers 41 and a paper discharge tray 42. The paper discharge rollers 41 discharge a sheet of paper that has arrived by being conveyed along the paper conveyance path S1 onto the paper discharge tray 42. And the paper discharge tray 42 stores a pile of paper sheets that have been discharged from the paper discharge rollers 41.

The paper discharge rollers 41 can rotate both forwards and backwards. When forming images on both sides of a sheet of paper, a sheet of paper upon one surface of which image formation has been completed is fed to the paper discharge rollers 41 via the paper conveyance path S1. At this time, the paper discharge rollers 41 are rotating in the direction to discharge the sheet into the paper discharge tray 42. Before the rear edge of the sheet passes the paper discharge rollers 41, the paper discharge rollers 41 are rotated in the opposite direction, still in the state in which they are gripping the sheet. The sheet passes along the paper conveyance path S1 in the opposite direction and is conveyed into the paper conveyance path S2 and is therein inverted front to back, and then receives transcription of a toner image in the state in which its back surface is faced towards the photoreceptor drum 31. After images have been formed upon both sides of the paper sheet, it is discharged into the paper discharge tray 42 by the paper discharge rollers 41.

When a start key provided upon the operation panel section is depressed, this image forming apparatus 100 supplies a sheet of paper into the paper conveyance path S1 by rotating the pickup rollers 22. This sheet of paper that has been supplied is conveyed to the paper stop rollers 51.

The paper stop rollers 51 stop rotating when the front edge of the sheet of paper has arrived at them. Then the paper stop rollers 51 start rotation at the timing at which the front edge of the sheet matches with the front edge of a toner image formed upon the photoreceptor drum between the photoreceptor drum 31 and the transfer device 34.

The image data that has been read by the manuscript reading unit 10 is transmitted as print data to the LSU 37, after having been subjected to image processing according to conditions inputted from the operation panel section. Based upon the above described image data, the LSU 37 creates a latent electrostatic image upon the surface of the photoreceptor drum 31, that has been electrified to a predetermined electrical potential by the charging device 1, by irradiating laser light thereupon via a polygonal mirror and various lenses not shown in the figure. Thereafter, toner that is adhered to the surface of a magnetic roller 33A provided in the development device 33 is attracted to the surface of the photoreceptor drum 31 corresponding to the differences in electrical potential upon the surface of the photoreceptor drum 31 and is adhered thereto, and thereby the latent electrostatic image is made visible by being converted into a toner image.

This toner image upon the surface of the photoreceptor drum 31 is transcribed onto the surface of the paper sheet by the transfer device 34. After this transfer process, the remaining toner upon the surface of the photoreceptor drum 31 is recovered by the cleaner unit 35.

After the transfer process has been completed, a sheet of paper is subjected to heat and pressure by passing through the fixing device 36, and the toner image is melted and adhered to the paper surface. After the toner image has thus been fixed, the paper sheet is discharged into the paper discharge tray 42 by the paper discharge rollers 41.

Figure 2B:
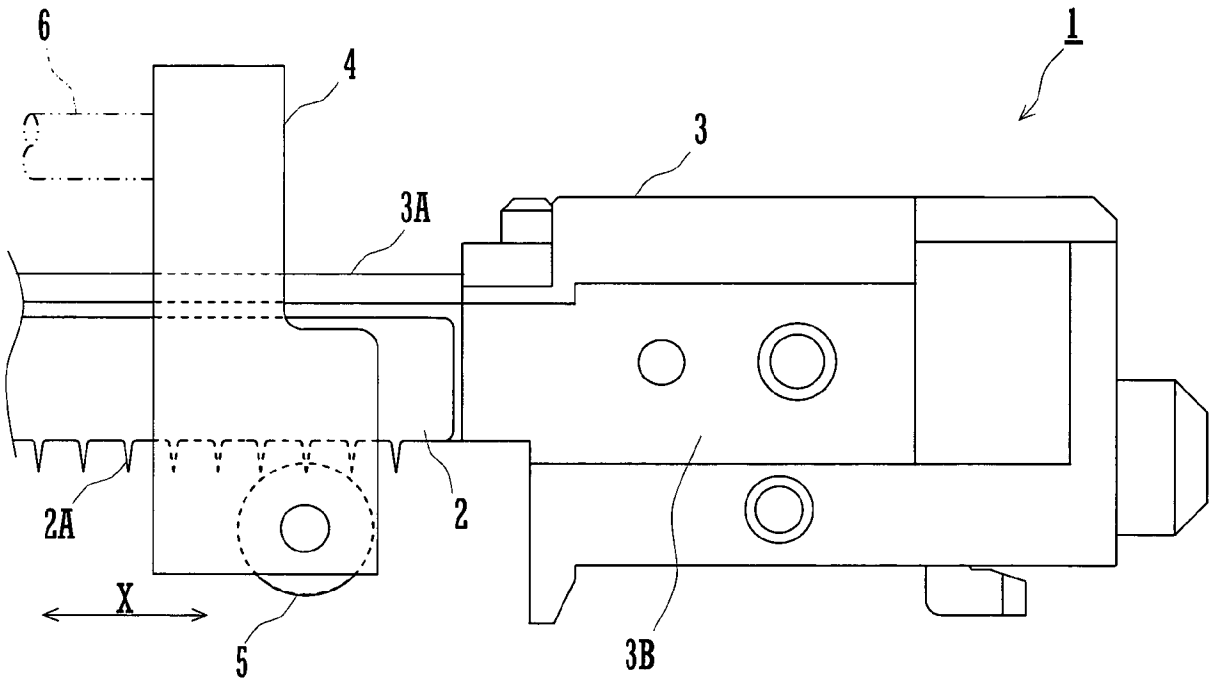
FIG. 2B is a side view of the portion.
Figure 2A:
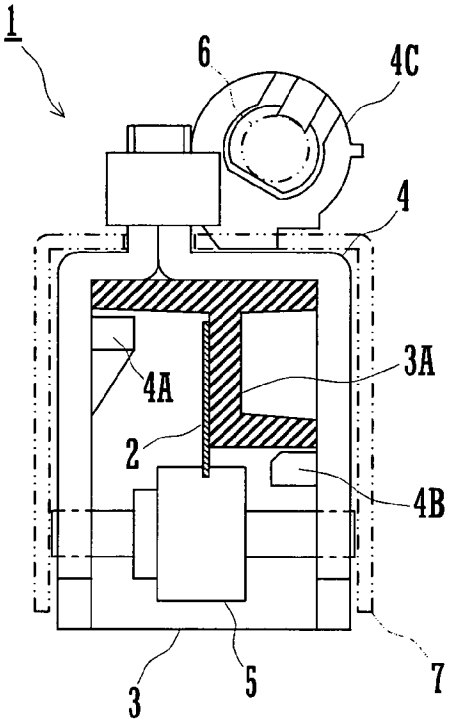
FIG. 2A is a front sectional view of a principal portion of the charging device.

FIG. 2A and FIG. 2B are respectively principal front sectional and side views, showing this charging device 1. The electrification device 1 includes a needle electrode 2, a holder 3, a support element 4, a cleaning roller 5, an actuation shaft 6, and a case 7. This charging device 1 is disposed over the photoreceptor drum 31.

The needle electrode 2 is made from a thin band shaped metallic material, and, from its lower edge portion, a plurality of needles 2A protrude, facing downwards, at fixed intervals over its total length. The plurality of needles 2A are arranged along an X direction that is parallel to the length direction of the needle electrode 2. The X direction corresponds to the "array direction" of the Claims. This charging device 1 is arranged so that the X direction of the needle electrode 2 runs parallel to the axial direction of the photoreceptor drum 31. The length of the needle electrode 2 is greater than the length of the circumferential surface of the photosensitive drum 31 in its axial direction.

The holder 3 is made from an insulating material such as resin or the like, and it includes a support portion 3A and a terminal portion 3B. The support portion 3A supports the needle electrode 2. The length of this support portion 3A is greater than the range over which the plurality of needles 2A are arrayed. The support portion 3A has a constant cross sectional shape in its section orthogonal to the X direction, as shown by the hatching in FIG. 2A. The terminal portion 3B supports a terminal not shown in the figures. This terminal is connected to a high voltage power supply not shown in the figures, and to the needle electrode 2.

The lower surface of the support element 4 is open, and is fitted over the outside of the support portion 3A from above. Projections 4A and 4B are formed upon the inner surfaces of the support element 4. In the vertical direction, the support element 4 sandwiches the support portion 3A between its upper inner surface and the projections 4A and 4B, while, in the horizontal direction, it sandwiches the support portion 3A between its inner side wall surfaces. Accordingly shifting of the support element 4, including rotation thereof, is regulated by its inner wall surfaces which are orthogonal to the X direction.

A cleaning roller 5, that is the "cleaning member" of the Claims, is supported by the lower end portion of the support element 4 so as to be rotatable. As one example thereof, this cleaning roller 5 may be an elastic member made from an EPDM type rubber material or an olefin type rubber material or the like, containing approximately 10% by weight of a polishing material such as aluminum powder or the like. The hardness of this polishing material should be set to be lower than the hardness of the raw material of the needle electrode 2, which for example may be stainless steel, while being higher than the hardness of the dirt or dust such as toner or the like. The tip portions of the needles 2A are embedded in the interior of the cleaning roller 5 from its circumferential surface inward.

As the elastic material of which the cleaning roller 5 is made, an appropriate material may be selected by experiment from heretofore known rubber materials and resin materials, provided that it deforms elastically without being easily cut by the needles 2A being stuck into it and exit from it. And, for the polishing material, a material selected appropriately from heretofore known materials may be used, and may be incorporated in the elastic material by a heretofore known method, provided that it is capable of eliminating dust and toner from the surfaces of the needles 2A without imparting any damage to the surfaces of the needles 2A.

The actuation shaft 6 corresponds to the "shaft element" of the Claims, and a rear side end portion thereof is fixed in a hole portion 4C of the support element 4. The front side end portion of the actuation shaft 6, not shown in the drawings, is projected from the front portion of the holder 3.

The case 7 is fitted over the support element 4, over the entire length of the holder 3. This case 7 shields the needle electrode 2.

When a high voltage power supply is applied to the needle electrode 2 via the terminal mounted upon the terminal portion 3B, the applied electrical field is concentrated at the tip portions of each of the plurality of needles 2A of the needle electrode 2, so that electrical discharge can easily take place at these portions. Due to this, electrical discharge to the surface of the photoreceptor drum 31 occurs from each of the plurality of needles 2A. And, due to this electrical discharge, the surface of the photoreceptor drum 31 is electrified to a predetermined electrical potential.

The cross sectional shape of the support portion 3A orthogonal to the X direction is constant at least within the range over which the plurality of needles 2A are arrayed. The support element 4 is fitted over the outside of the support portion 3A. The support element 4 is arranged so as to restrict its movement, including its rotation, in a surface thereof orthogonal to the X direction. The support element 4 is guided by the support portion 3A, so as to be movable and to reciprocate along the X direction, at least within the range over which the plurality of needles 2A are arrayed.

Figure 3:
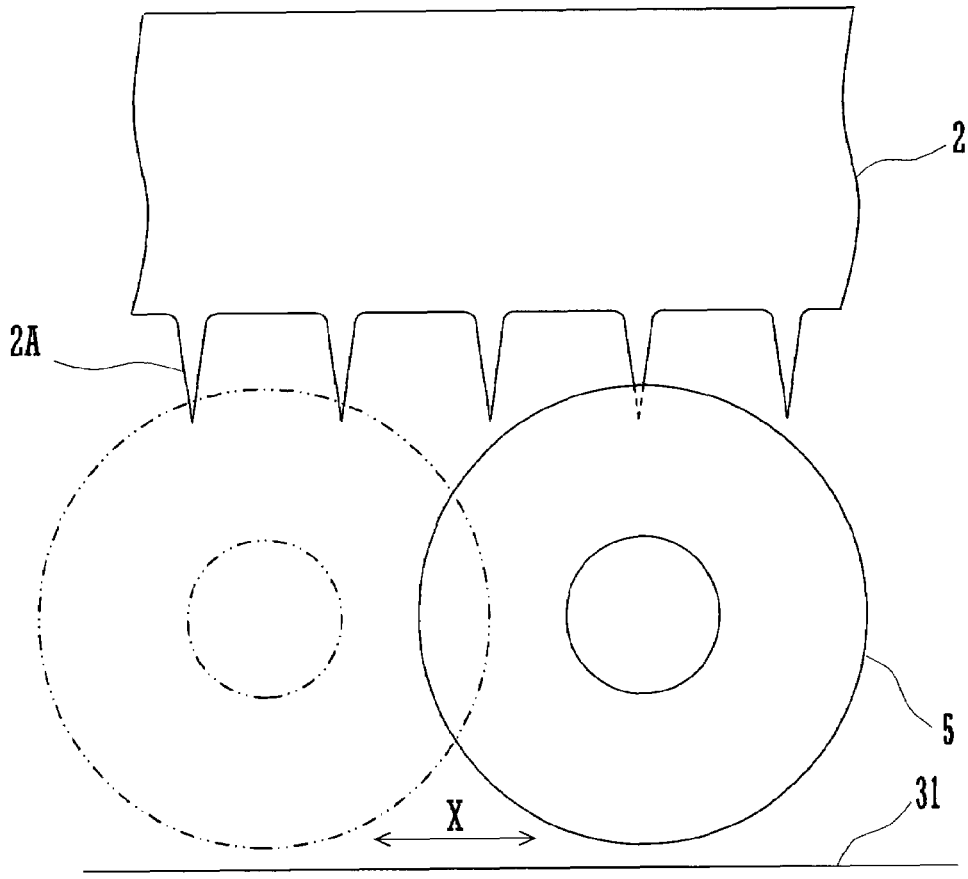
FIG. 3 is a figure showing a cleaning operation by a cleaning roller.

FIG. 3 is a figure showing the cleaning operation by the cleaning roller 5. When the support element 4 moves along the X direction, the cleaning roller 5 also moves along with the support element 4. At this time, each of the plurality of needles 2A sequentially embeds itself in the circumferential surface of the cleaning roller 5. The cleaning roller 5 is moved along the X direction while rotating, due to the resistance caused from the plurality of needles 2A that operate upon its circumferential surface. When the cleaning roller 5 thus shifts along the X direction while rotating, the tip portions of the needles 2A, after having been embedded in the interior of the circumferential surface of the cleaning roller 5, exit to the exterior therefrom.

The cleaning roller 5 is arranged between the needle electrode 2 and the circumferential surface of the photoreceptor drum 31. The diameter of this cleaning roller 5 is made to be as large as possible, provided that it does not contact the circumferential surface of the photoreceptor drum 31. While the cleaning roller 5 is thus moving in the X direction, always, the tip portion of at least of one of the needles 2A is embedded into the cleaning roller 5 from its circumferential surface. The cleaning roller 5 is rotated while it shifts in the X direction, so that damage to the circumferential surface of the cleaning roller 5 due to the tip portions of the needles 2A, and deformation of the needles 2A due to the circumferential surface of cleaning roller 5, are kept down to the minimum limit.

Figure 4:
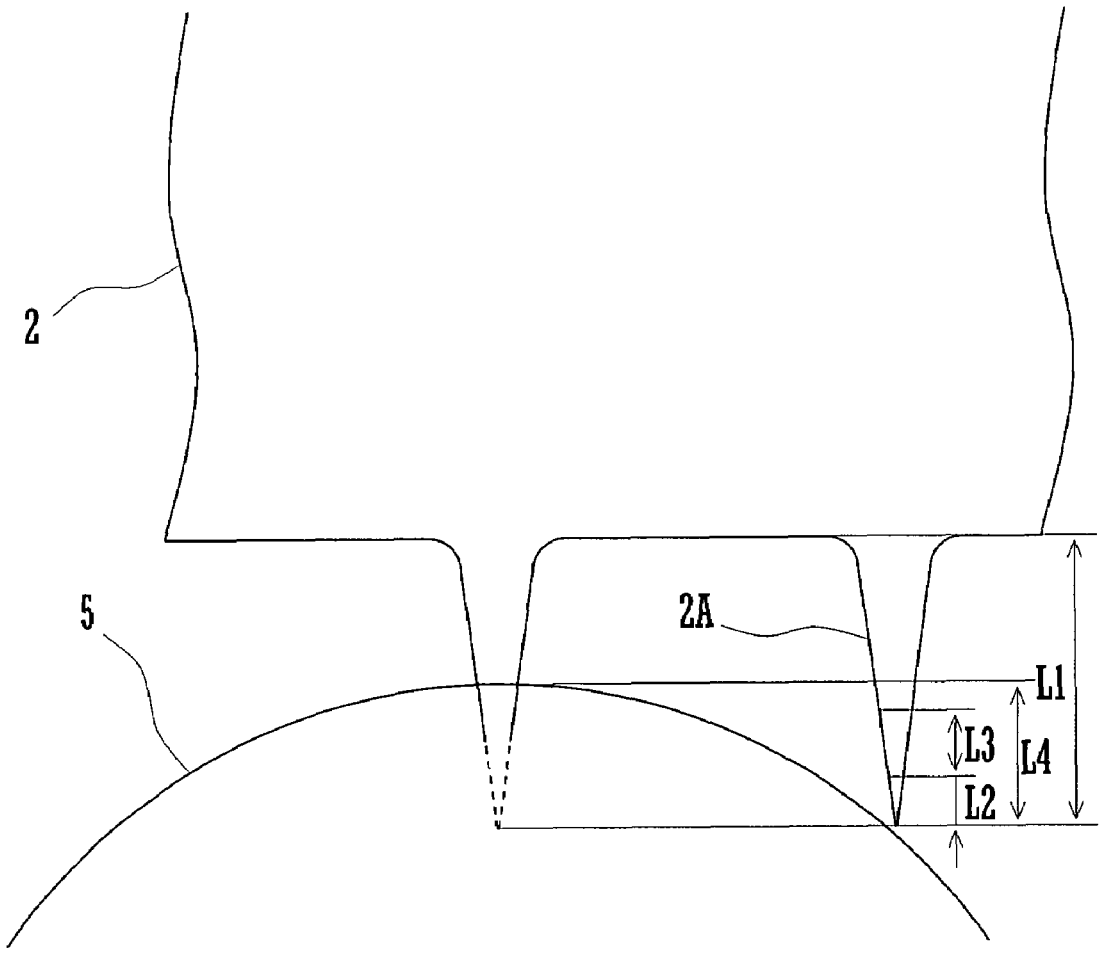
FIG. 4 is a figure showing the length by which the needles of the needle electrode are embedded in the cleaning roller.

The support position of the support element 4 for the cleaning roller 5 is set so that a tip portion of a predetermined length from the end of each of the needles 2A is embedded in the circumferential surface of the cleaning roller 5. In more detail, as shown in FIG. 4, with the length L1 of the needles 2A being 1.5 mm, the length L2 of their electrical discharge regions is 0.1~0.2 mm. The embedding distance L4 becomes 0.6~1.0 mm. When the needle 2A is embedded in the cleaning roller 5, elastic deformation in the needle 2A takes place over a range of length L3=0.3~0.4 mm from the electrical discharge region L2.

When the cleaning roller 5 moves along the X direction with the support element 4, after the tip portion of each needle 2A has been gradually stuck from its end into the interior of the cleaning roller 5, then it is gradually withdrawn and exposed to the exterior. During this process, the entire tip portion of the needle 2A contacts against the elastic material of which the cleaning roller 5 is made, and is polished by the polishing material that this elastic material contains. Since the cleaning roller 5 rotates while the plurality of needles 2A are inserted thereinto and withdrawn therefrom in order, accordingly at least each pair of two adjoining needles 2A are embedded into the circumferential surface of the cleaning roller 5 in different positions. Due to this, the entire surfaces of the tip portions of the needles 2A are cleaned in a reliable manner.

Figure 5:
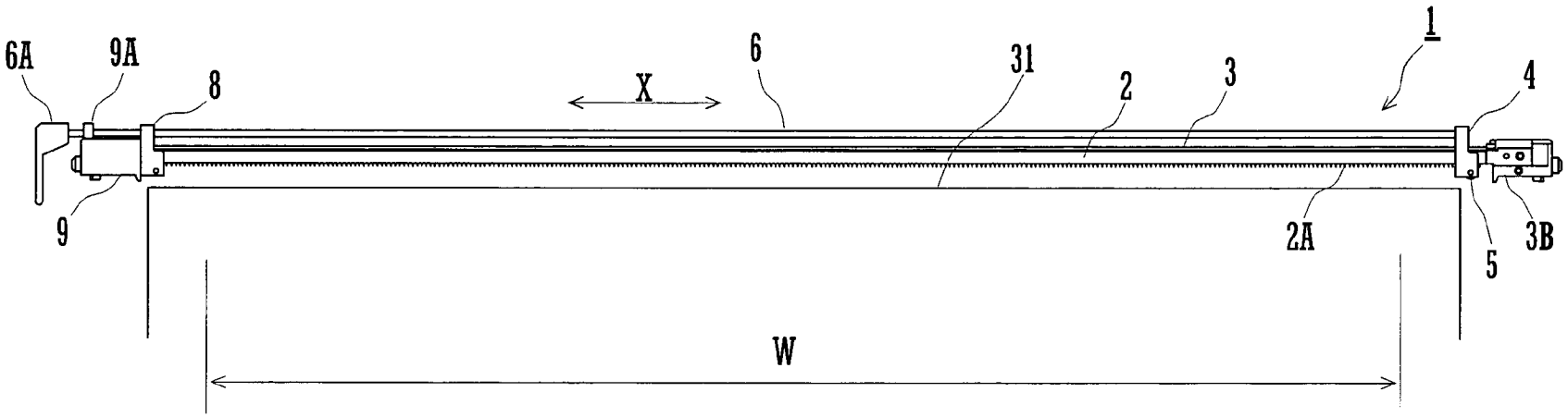
FIG. 5 is a side view of the charging device.

FIG. 5 is a side view of the charging device 1. The charging device 1 includes the actuation shaft 6 on its upper side. The actuation shaft 6 is of a length that is approximately equivalent to the total length of the holder 3. The end portion on the rear side of the actuation shaft 6 is fixed in the hole portion 4C of the support element 4. A fitting portion 9 is formed upon the front end portion of the holder 3. The fitting portion 9 has approximately the same external shape as the terminal portion 3B. A bearing element 8 is fixed to the rear surface side of the fitting portion 9. For the bearing element 8, the same member as the support element 4 is used, and is provided with a hole portion 4C in its upper portion. A bearing 9A is formed on the upper surface of the fitting portion 9.

The actuation shaft 6 passes through the hole portion 4C of the bearing element 9 and the bearing 9A of the fitting portion 9. A grip 6A is fitted upon the end portion of the front side of the actuation shaft 6. In the state in which the charging device 1 is mounted within the image forming apparatus 100, the end support portion 3A, the bearing element 8, and the fitting portion 9 are positioned outside the range of the image formation region W upon the surface of the photoreceptor drum 31. Furthermore, in the state in which cleaning is not being performed, the support element 4 is positioned in a waiting position, that is set within a range on the outside of the image formation region W upon the surface of the photoreceptor drum 31. The support element 4, the end support portion 3A, the bearing element 8, and the fitting portion 9 do not constitute an impediment to image formation upon the surface of the photoreceptor drum 31.

When the operator wishes to clean the needle electrode 2, he grasps the grip 6A and pulls the actuation shaft 6 to and fro along the X direction. By doing this, the support element 4 is moved to and fro along the X direction while being guided by the support portion 3A, and, while the cleaning roller 5 which is supported by the support element 4 rotates, the plurality of needles 2A of the needle electrode 2 are embedded in order into the surface thereof.

When the tip portions of the plurality of needles 2A of the needle electrode 2 are stuck into and withdrawn from the interior of the cleaning roller 5 in order, then, since the entire extent of the tip portion of each of the needles 2A is contacted against the cleaning roller 5, and no deformation of the needles 2A and no adherence of fibers takes place, accordingly the entire surfaces of the tip portions of the needles 2A can be cleaned in a reliable manner.

Furthermore, the actuation shaft 6 is supported at three points: the support element 4, the bearing element 8, and the bearing 9A. Thereby, it is possible to perform reciprocating operation of the actuation shaft 6 to and fro along the X direction in a smooth manner.

It is not necessary to use a cleaning roller 5 as the cleaning member; it would also be acceptable to use some rotating element, that is supported upon the support element 4 so as to be rotatable.

Figure 6:
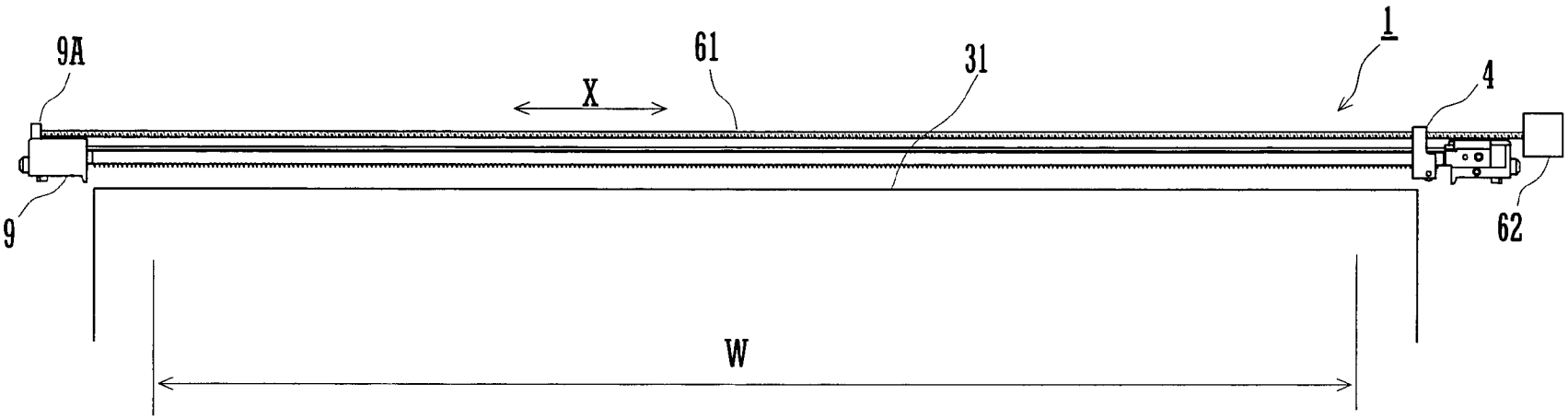
FIG. 6 is a side view of the charging device according to another embodiment.

FIG. 6 is a side view of an charging device 1. In the charging device 1 according to this embodiment, instead of the actuation shaft 6 of the charging device 1 shown in FIGS. 2 through 4, a threaded rod 61 and a motor 62 are provided, and a internal thread portion is formed in a hole portion 4C of the support element 4. The rotation of the motor 62 is transmitted to this threaded rod 61. The motor 62 is the drive source of the Claims, and can rotate both forwards and in reverse. The internal thread portion is screwed over the threaded rod 61.

The support element 4 is arranged so as to restrict its movement in a surface thereof orthogonal to the array direction X with respect to the holder 3. The support element 4 cannot rotate around the array direction X as an axis. The rotation of the threaded rod 61 is converted into a moving force in the axial direction of the threaded rod 61, which is transmitted to the support element 4. By rotation in both forward and backward directions being supplied from the motor 62 to the threaded rod 61, it is possible to shift the support element 4 to and fro along the array direction X. And, by driving the motor 62 at a predetermined timing, it is possible to perform the cleaning of the needle electrode 2 automatically.

It would be possible to arrange for a compact motor 62 to be fitted to the electrification device 1, so that, when the charging device 1 is mounted to the image forming apparatus 100, this motor 62 is electrically connected to the power supply unit of the image forming apparatus 100. It would also be acceptable to arrange for the motor 62 to be fitted to the image forming apparatus 100, so that, when the charging device 1 is mounted to the image forming apparatus 100, an end portion of the threaded rod 61 at its rear side is mechanically connected to the rotation shaft of the motor 62.

Finally, in the above described embodiments, all of the features are shown by way of example, and should not be considered as being limitative of the present technology. The scope of the present technology is not to be defined by any of the features of the embodiment described above, but only by the scope of the appended Claims. Moreover, equivalents to elements in the Claims, and variations within their legitimate and proper scope, are also to be considered as being included within the range of the present technology.

What is claimed is:

1. A charging device, comprising:

a needle electrode in which a plurality of needles that protrude towards a surface of a photoreceptor are arrayed in a straight line;

a holder that holds the needle electrode and whose cross sectional shape orthogonal to the array direction is constant at least within the range of the array direction over which the plurality of needles are arrayed;

a cleaning roller that is disposed between the photoreceptor surface and the needle electrode so as to be movable along an array direction of the plurality of needles; and a support element that is held by the holder arranged so as to restrict its movement in directions orthogonal to the array direction, and that rotatable supports the cleaning roller, wherein, during movement of the cleaning roller along the needle electrode, tip portions of each of the plurality of needles are sequentially embedded into and then removed from the cleaning roller, and at least one of the plurality of needles is always embedded in the interior of the cleaning.

2. A charging device as described in claim 1, further comprising a shaft member, a first end portion of which is fixed to the support element and a second end portion of which is exposed at a front end portion of the holder, and that is supported at two spots of the holder along the array direction so as to be movable in the array direction.

3. A charging device as described in claim 1, further comprising a threaded rod that is supported by the holder so as to be rotatable around an axis parallel to the array direction, and that has a screw portion whose length is equal to or longer than the array range;

a screw element that is fixed to the support element and is engaged over the threaded rod; and a drive source that supplies rotation in both forward and reverse directions to the threaded rod.

4. A charging device as described in claim 1, wherein the cleaning roller is set to a wait position within a range of the array direction outside the image formation region of the photosensitive surface.

5. A charging device as described in claim 1, wherein the cleaning roller is made from an elastic material that contains a polishing material whose hardness is lower than that of the raw material of the needles.

6. An image forming apparatus that performs image formation by a method of electronic photography via a photosensitive element, comprising a charging device as described in claim 1.

7. A charging device as described in claim 5, wherein the cleaning roller contains between 6% and 10% by weight of the polishing material.

* * * * *